US006065316A

United States Patent [19]

Sato et al.

[11] Patent Number: 6,065,316

[45] Date of Patent: May 23, 2000

[54] CAR DOOR LOCK SYSTEM

[75] Inventors: Hironobu Sato; Kazunori Watanabe, both of Wako, Japan

[73] Assignee: Honda Giken Kogyo Kabushiki Kaisha, Tokyo, Japan

[21] Appl. No.: 09/137,900

[22] Filed: Aug. 20, 1998

[30] Foreign Application Priority Data

Aug. 29, 1997 [JP] Japan ..... 9-234910

[51] Int. Cl.[7] ..... E05B 53/00

[52] U.S. Cl. ..... 70/264; 70/275; 292/201; 292/DIG. 23

[58] Field of Search ..... 292/201, 216, 292/DIG. 23, DIG. 42, 144, DIG. 43; 70/264, 277, 282, 281, 280, 279, 283, 275

[56] References Cited

U.S. PATENT DOCUMENTS

| | | | |
|---|---|---|---|
| 4,872,714 | 10/1989 | Brusasco | 292/201 |
| 4,974,885 | 12/1990 | Yokoyama | 292/201 |
| 5,137,312 | 8/1992 | Tang | 292/336.3 |
| 5,238,274 | 8/1993 | Becker et al. | 292/201 |
| 5,411,302 | 5/1995 | Shimada | 292/201 |
| 5,438,855 | 8/1995 | Ikeda | 70/279 |
| 5,534,846 | 7/1996 | Kuroda | 292/201 |
| 5,618,068 | 4/1997 | Mitsui et al. | 292/201 |
| 5,802,894 | 9/1998 | Jahrsetz et al. | 70/264 |
| 5,887,466 | 3/1999 | Yoshizawa | 70/264 X |
| 5,934,717 | 8/1999 | Wirths et al. | 292/201 |

FOREIGN PATENT DOCUMENTS 5-32605 8/1993 Japan .

*Primary Examiner*—Teri Pham
*Attorney, Agent, or Firm*—Merchant & Gould P.C.

[57] ABSTRACT

A door lock system for a vehicle of which a striker, a first switch and a manual switching mechanism are mounted to the vehicle door and a first latch, a first motor, a second latch, a second motor, a second switch and a key cylinder are mounted to the vehicle body. When the key cylinder mounted to the vehicle body is switched to an unlock side, the second switch rotates the second motor, but the second latch remains engaged with the first latch. When after that the first switch is turned on by the manual switching mechanism on the door side, the first motor rotates and the first latch releases the striker.

1 Claim, 10 Drawing Sheets

CAR DOOR LOCK SYSTEM

BACKGROUND OF THE INVENTION

1. Field of the Invention

This invention relates to an improvement in a car door lock system.

2. Description of the Related Art

In recent years, as car door lock systems, so-called two-stage door lock systems with which a key cylinder is unlock-operated and then a door is unlocked by an operating lever being unlock-operated have been widely used. A car door lock system of this kind is disclosed for example in Japanese Utility Model Publication No. HEI-5-32605.

In this lock system, by unlocking a key cylinder and inclining a bell crank connected to the end of a rod, a long and thin plate-like opener lever connected to the bell crank is moved horizontally and then an outer handle 6 is operated to incline the opener lever and a lock device mounted at the lower end of the rod is thereby disengaged from a striker to open a back door.

In this lock system, the striker is mounted to the vehicle body and all of the rest of the lock mechanism is mounted to the back door.

However, when the door is small, there are space restrictions on mounting many lock mechanisms to the door. For this reason, it would be preferable for the striker to be mounted to the door and for the lock mechanisms to be mounted to the vehicle body.

However, generally, in order to open the door of a vehicle with one hand, the door is opened while the outer handle is being operated. Consequently, if the outer handle is mounted to the vehicle body the operation of opening the door becomes more difficult.

Considering this point, it is conceivable to mount the striker and the outer handle to the door and mount the rest of the locking mechanism to the vehicle body; however, because it then becomes impossible to connect the outer handle to the locking mechanism with a rod, this configuration is mechanically unworkable.

Consequently there has been a need for a two-stage type door lock system with which it is possible to open a door easily with one hand by performing an unlocking operation on the door side after unlocking a key cylinder mounted on the vehicle body side.

SUMMARY OF THE INVENTION

The present invention provides a car door lock system comprising: a substantially U-shaped striker; a first latch for locking the striker; a first motor for switching the first latch between a locking state and a non-locking state; a first switch for starting the first motor; a manual switching mechanism for switching the first switch on and off; a second latch for locking the first latch in its locking state; a second motor for driving the second latch; a second switch for starting the second motor; and a key cylinder for switching the second switch, wherein the striker, the first switch and the manual switching mechanism are mounted to the door and the first latch, the first motor, the second latch, the second motor, the second switch and the key cylinder are mounted to the vehicle body.

When the key cylinder on the vehicle body side is switched to an unlocked side, the second switch rotates the second motor but the second latch remains engaged with the first latch. When after that the first switch is turned on or off with the manual switching mechanism on the door side, the first motor is rotated by way of the first switch and as a result the first latch releases the striker on the door side. That is, because a lock system according to the present invention is a two-stage operation type electric door lock system, it is possible to open the door by unlocking the key cylinder and then unlocking the manual switching mechanism on the door side and opening the door at the same time with one hand.

Also, because only the striker, the first switch and the manual switching mechanism are mounted to the door, the door lock system can be mounted easily even when the door is a small one with restricted mounting space.

BRIEF DESCRIPTION OF THE DRAWINGS

A preferred embodiment of the present invention will now be described in detail, by way of example only, with reference to the accompanying drawings, in which.

DETAILED DESCRIPTION OF THE PREFERRED EMBODIMENTS

The following description is merely exemplary in nature and is in no way intended to limit the invention or its application or uses.

Figure 1:
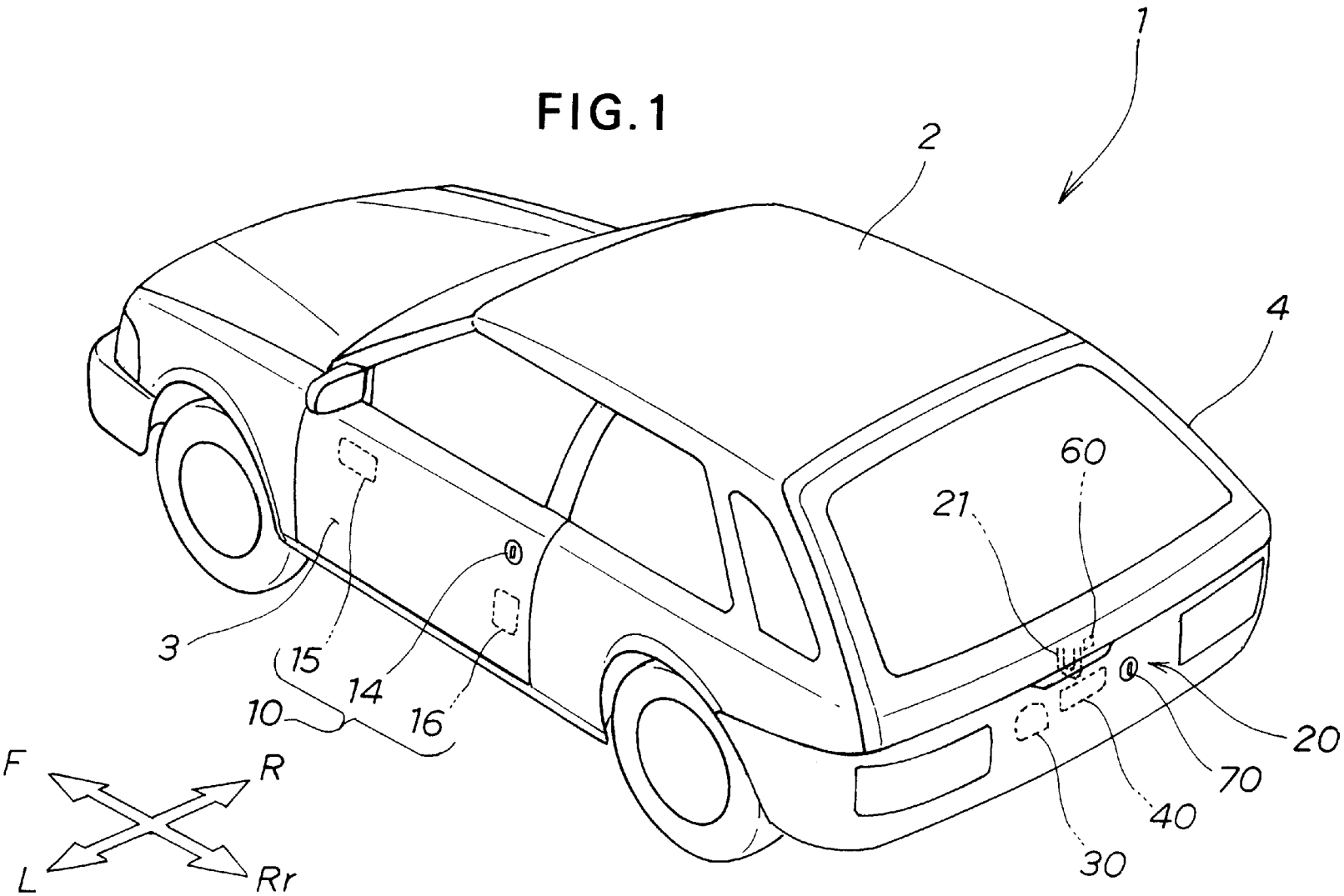
FIG. 1 is a perspective view of a car fitted with a lock system according to the present invention.

In FIG. 1, the arrow Fr shows the front direction of a car 1 when the driver is taken as a reference, Rr shows the rear direction, L shows the left direction and R shows the right direction.

The car 1 is a hatchback type vehicle having side doors 3 mounted in the sides of a vehicle body 2 and a back door 4 attached by a hinge to the upper part of the rear of the vehicle body 2, and is fitted with a car door lock system according to the invention.

Figure 2:
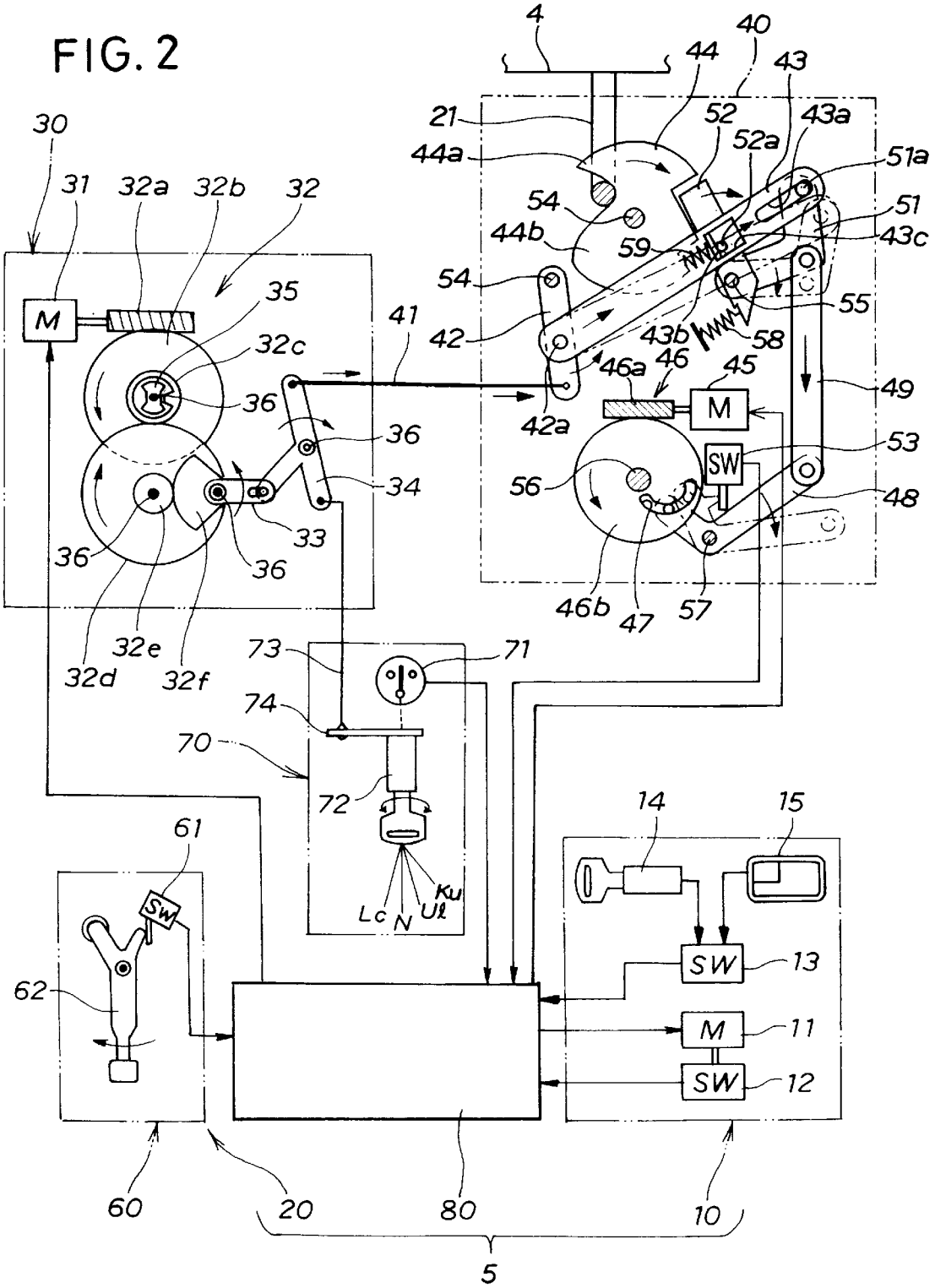
FIG. 2 is a schematic system view of the car door lock system of FIG. 1.

Referring now to FIG. 2, the car door lock system 5 is made up of a side door lock device 10, a back door lock device 20 and a control unit 80.

The control unit 80 is a unit for controlling the side door lock device 10 and the back door lock device 20, and has a microcomputer.

The side door lock device 10 is made up of a door lock motor 11, a response switch 12 which operates in response to the door lock motor 11, a control switch 13 for starting the door lock motor 11, a key cylinder 14 for switching the control switch 13, and a lock knob 15.

The back door lock device 20 comprises a substantially U-shaped striker 21 attached to the back door 4, an opening actuator unit 30, a lock actuator unit 40, a manual switching unit 60, and a key cylinder unit 70.

The opening actuator unit 30 is made up of a main motor (first motor) 31, a gear mechanism 32 (made up of a main worm gear mechanism consisting of a worm 32*a* and a wheel 32*b*; a first small gear 32*c*, a large gear 32*d*, a second small gear 32*e* and a sector gear 32*f*) connected to the main motor 31, a first main lever 33 connected to the sector gear 32*f*, and a second main lever 34 connected to the first main lever 33. The reference numeral 35 denotes a slip mechanism, and the reference numeral 36 denotes support shafts of the various members.

The lock actuator unit 40 is made up of a third main lever 42 connected to the second main lever 34 by a first rod 41, a main link 43 pivotally connected to the third main lever 42 by a connecting pin 42*a*, an auxiliary latch 52 connectable to a bent-out portion 43*b* of the main link 43 by contact with a pin 52*a*, a main latch 44 for locking the striker 21, a fourth main lever 51 linked to the main link 43, an auxiliary motor (second motor) 45 for driving the fourth main lever 51, an auxiliary worm gear mechanism 46 (made up of a worm 46*a* and a wheel 46*b*) connected to the auxiliary motor 45, a first auxiliary lever 48 engaged by a pin with a cam groove 47 of the wheel 46*b*, an auxiliary link 49 connected to the first auxiliary lever 48 and the fourth main lever 51, and an auxiliary response switch 53 which operates in response to the first auxiliary lever 48. The reference numerals 54, 55, 56 and 57 denote support shafts.

The main latch 44 rotates to the left and right about the support shaft 54 to lock and unlock the striker 21. The auxiliary latch 52 rotates to the left and right about the support shaft 55 to hold the main latch 44 in its locking state.

The main motor 31 switches the main latch 44 between its locking state and its non-locking state. The auxiliary motor 45 drives the fourth main lever 51 (switches it between a lock state and an unlock state).

The main link 43 and the fourth main lever 51 are connected by a pin 51*a* provided on the fourth main lever 51 fitting in a slot 43*a* formed in the main link 43.

The auxiliary response switch 53 operates in response to the auxiliary motor 45 so as to turn on when the fourth main lever 51 moves to its unlock position.

The manual switching unit 60 is made up of a first switch 61 for switching the main motor 31 on and off and a manual switching mechanism 62 for switching the first switch 61 on and off.

The key cylinder unit 70 is made up of a second switch 71 for starting the auxiliary motor 45, a key cylinder 72 for switching the second switch 71, and an arm 74 and a second rod 73 for connecting the key cylinder 72 with the second main lever 34.

Figure 3:
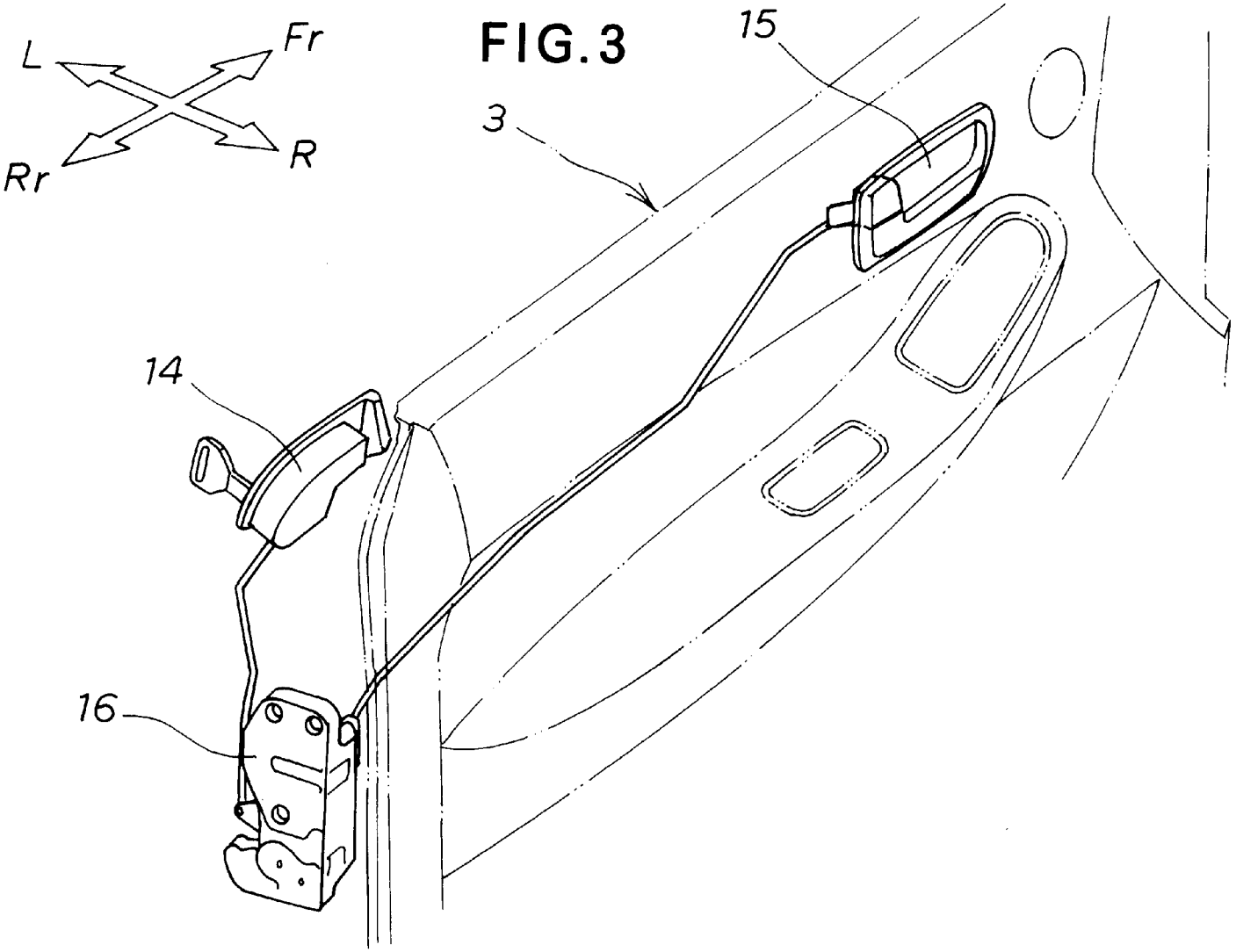
FIG. 3 is a perspective view of a side door shown in FIG. 1.

FIG. 3 is a perspective view of a side door pertaining to the invention, and shows part of a left side door 3 as seen from the inside of the car.

A lock mechanism 16 is mounted inside the side door 3. The door lock motor 11, the response switch 12 and the control switch 13 shown in FIG. 2 are built into this lock mechanism 16. A key cylinder 14 is mounted in the outer side of the side door 3. The lock knob 15 is mounted in the inner side of the side door 3.

Figure 4:
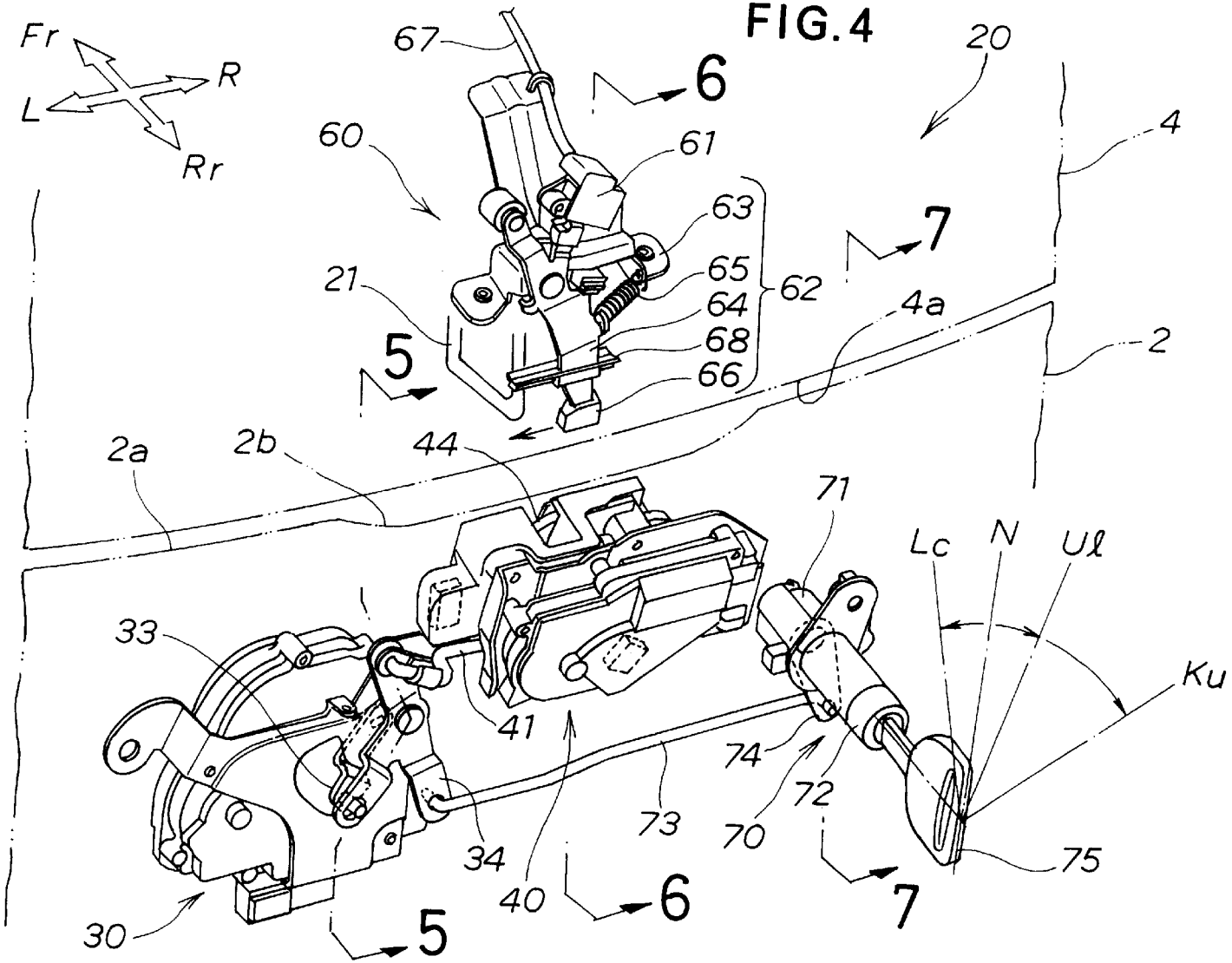
FIG. 4 is a perspective rear view of a back door lock device of FIG. 1.

FIG. 4 is a perspective view of a back door lock device 20 according to the invention.

The striker 21 and the manual switching unit 60 are mounted in the back door 4. The opening actuator unit 30, the lock actuator unit 40 and the key cylinder unit 70 are mounted in the vehicle body 2.

The lock actuator unit 40, the striker 21 and the manual switching unit 60 are disposed in the width direction center of the car. The opening actuator unit 30 is disposed on the left side of the lock actuator unit 40 and the key cylinder unit 70 is disposed on its right side.

Thus the back door lock device 20 has a construction wherein the striker 21, the first switch 61 and the manual switching mechanism 62 are mounted in the back door 4 and the main latch 44, the main motor 31, the auxiliary latch 52, the auxiliary motor 45, the second switch 71 and the key cylinder 72 shown in FIG. 2 are mounted in the vehicle body 2.

The manual switching mechanism 62 of the manual switching unit 60 is a lever mechanism made up of a lever 64 attached to a base 63 pivotally in the width direction of the car and a tension spring 65 for returning the lever 64 to a neutral position shown in the figure. When a knob 66 at the lower end of the lever 64 is turned clockwise in the figure, the upper end of the lever 64 turns on the first switch 61, which is a microswitch, and when the knob 66 is released the lever 64 is returned to the neutral position by the tension force of the lever 64.

Because the operating direction of the manual switching mechanism 62 is the car width direction, compared to when it is the front-rear direction of the car the depth dimension of the back door 4 can be kept small.

The vehicle body 2 has in the width direction center of the car at the opening edge 2*a* thereof a cutaway 2*b* to allow a hand to grip the lower edge 4*a* of the back door 4.

The key cylinder 72 can be switched by turning of a key 75 between a lock position Lc on the left of a neutral position N, an unlock position Ul on the right and a forcible unlock position Ku further to the right.

Figure 5:
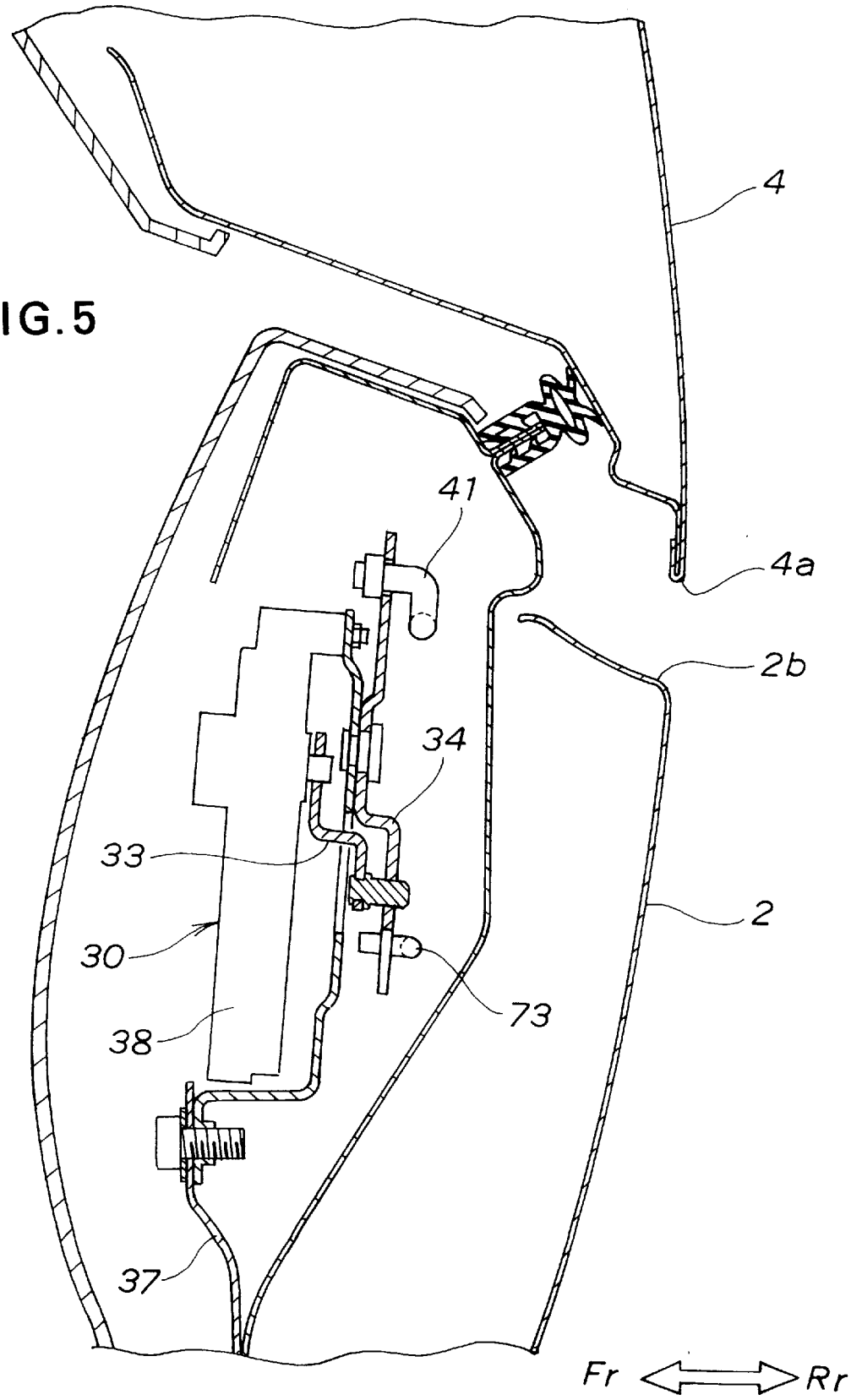
FIG. 5 is a sectional view taken along line 5—5 in FIG. 4.

FIG. 5 is a sectional view on the line 5—5 in FIG. 4, and shows that the opening actuator unit 30 is attached to the inside of the vehicle body 2 by a support 37. The reference numeral 38 denotes a case of the opening actuator unit 30.

Figure 6:
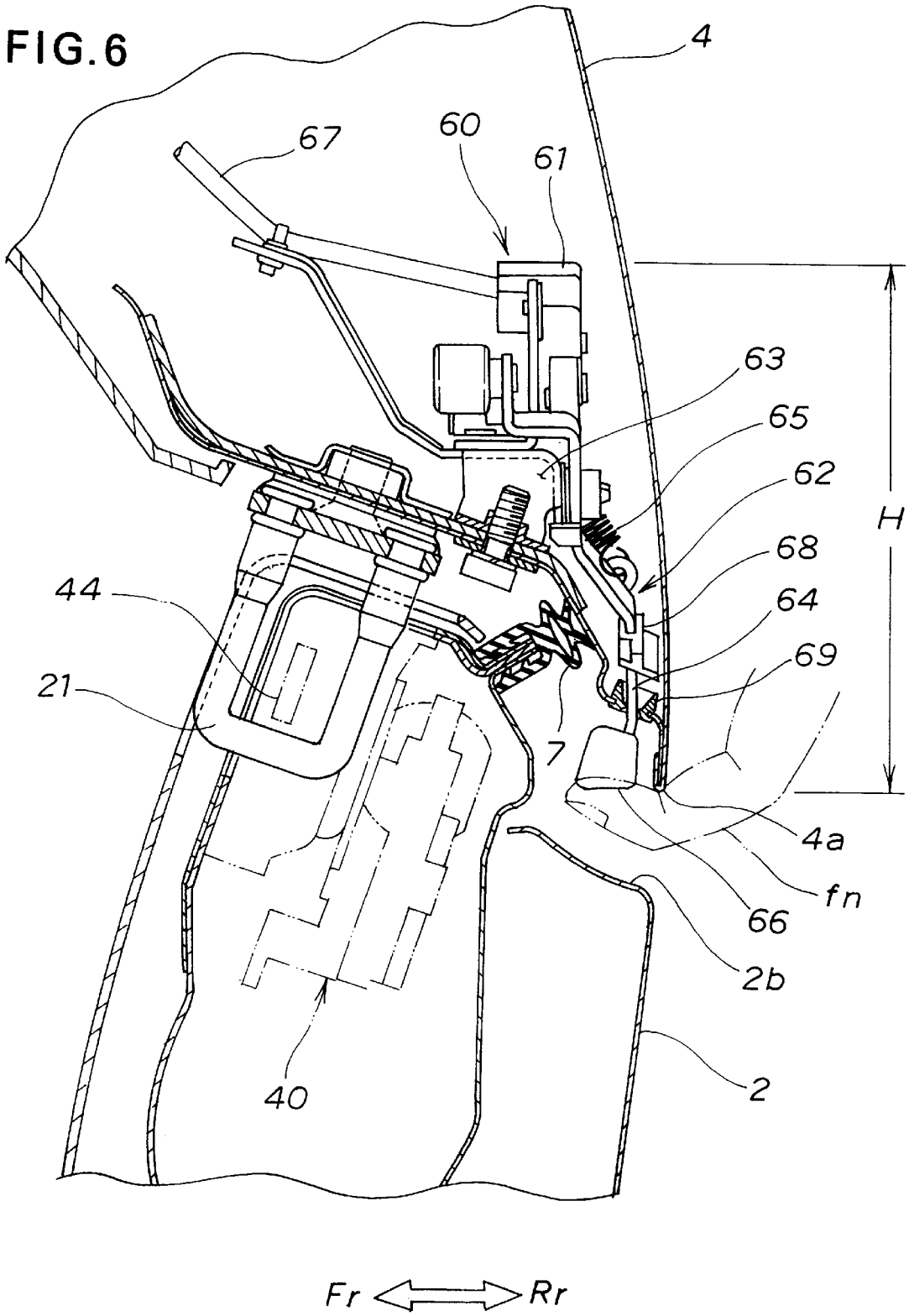
FIG. 6 is a sectional view taken along line 6—6 in FIG. 4.

FIG. 6 is a sectional view on the line 6—6 in FIG. 4, and shows the lock actuator unit 40 mounted on the inside of the vehicle body 2, the striker 21 bolted to the bottom of the back door 4, and the manual switching unit 60 bolted to the bottom of the inside of the back door 4.

The lever 64 extends from the bottom of the back door 4 toward the cutaway 2*b* in the vehicle body 2 so that the lower end of the knob 66 is approximately in the same plane as the lower edge 4*a* of the back door 4. Because the knob 66 faces the cutaway 2*b*, the knob 66 can be operated by a finger fn of a hand gripping the lower edge 4*a* of the back door 4.

Because only the striker 21, the first switch 61 and the manual switching mechanism 62 are mounted in the back door 4, the height H required for the mounting of lock system parts in the back door 4 can be small. Consequently, even if the back door 4 is a small one such that there are mounting space restrictions, the striker 21, the first switch 61 and the manual switching mechanism 62 can be mounted easily.

Also, because the back door lock device 20 (see FIG. 2) is an electric door lock device, the only connection between the first switch 61 and the manual switching mechanism 62 mounted in the back door 4 and the other lock parts 30, 40, 70 and 80 (see FIG. 2) mounted in the vehicle body 2 is a thin signal wire (harness) 67 running from the first switch 61 to the vehicle body 2 side. In FIG. 6, the reference numeral 7 denotes a packing for sealing between the vehicle body 2 and the back door 4; 68 is a seal member; and 69 is another packing.

Figure 7:
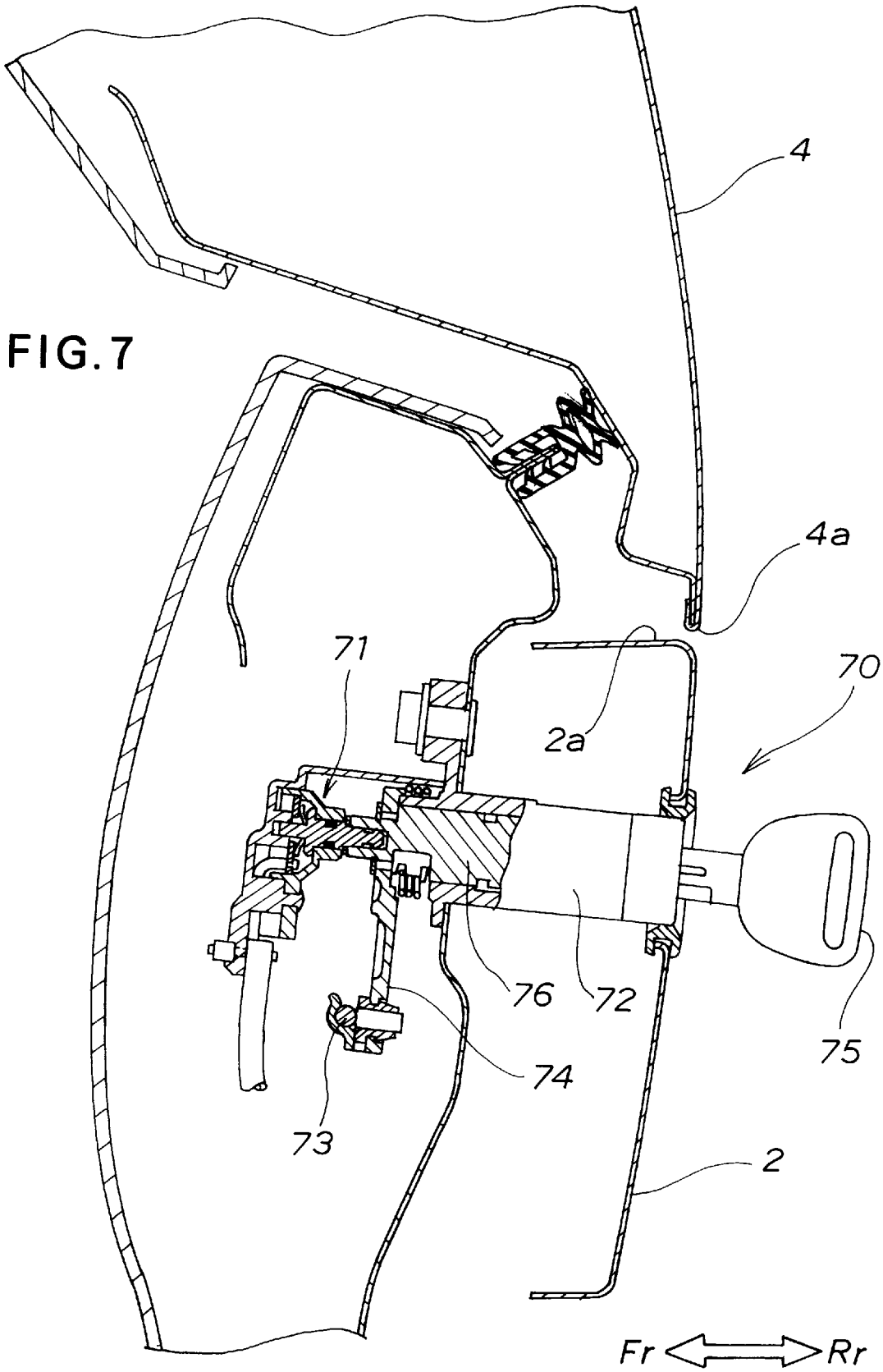
FIG. 7 is a sectional view taken along line 7—7 in FIG. 4.

Referring now to FIG. 7, the key cylinder unit 70 is mounted in the vehicle body 2. the second switch 71, which is a rotary switch, and the arm 74 are connected to a shaft 76 of the key cylinder 72 in the key cylinder unit 70.

The arm 74 and the shaft 76 are connected by way of a slip mechanism (not shown). This slip mechanism has an amount of play such that the arm 74 and the shaft 76 connect together when the key 75 is operated beyond the range of the lock position Lc to the unlock position Ul shown in FIG. 4.

Figure 8:
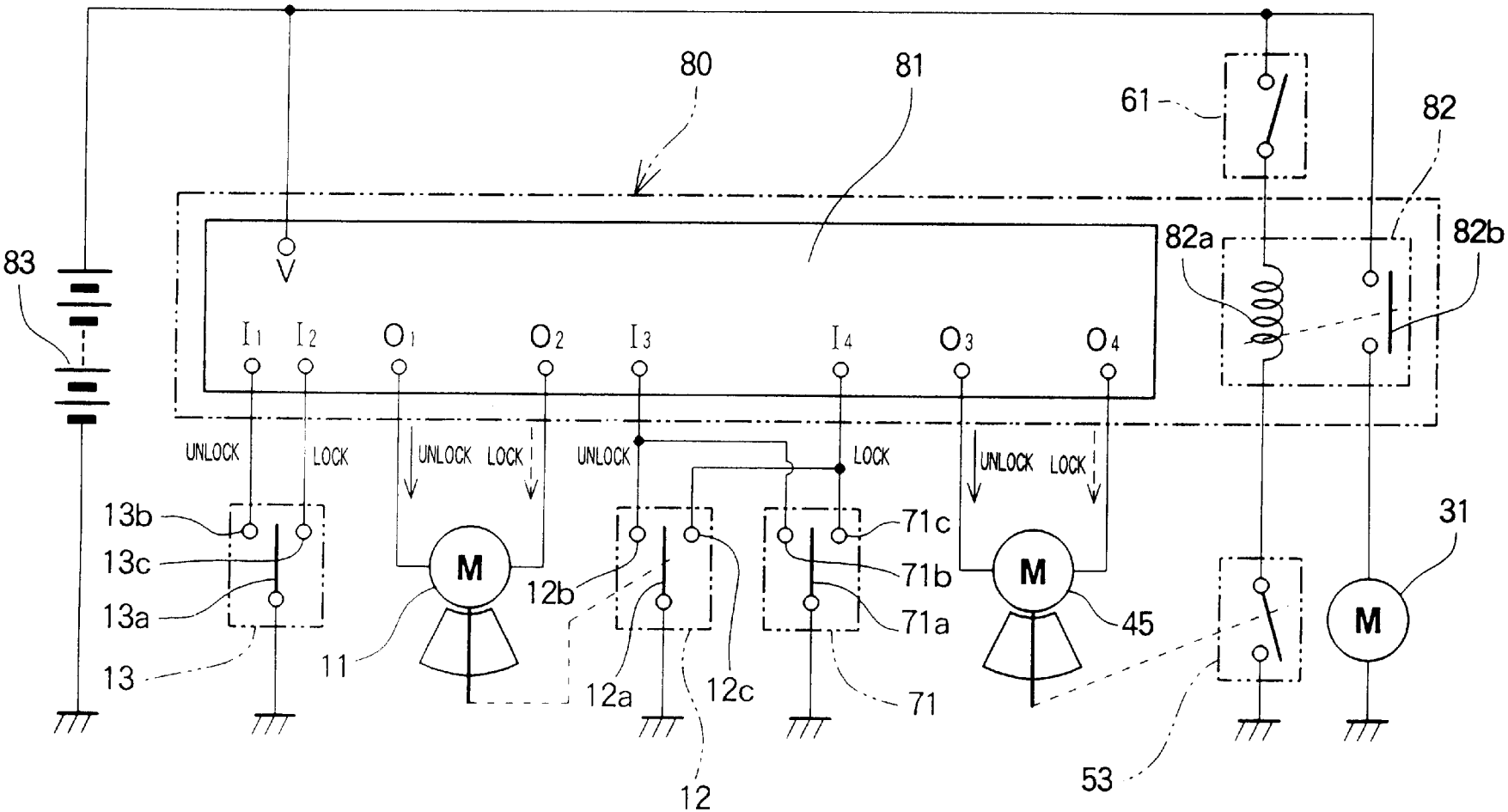
FIG. 8 is an electrical circuit diagram of a car door lock system according to the present invention.

FIG. 8 shows the electrical circuit a of car door lock system according to the invention.

In FIG. 8, the response switch 12 is made up of a moving contact 12*a* which moves in response to rotation of the door lock motor 11, a first fixed contact 12*b* with which the moving contact 12*a* makes contact when the door lock motor 11 has rotated forward through a predetermined angle, and a second fixed contact 12*c* with which the moving contact 12*a* makes contact when the door lock motor 11 has rotated in reverse through a predetermined angle. The response switch 12 produces a side door "unlocking completed" signal when the door lock motor 11 has rotated forward through a predetermined angle, and produces a side door "locking completed" signal when the door lock motor 11 has rotated in reverse through a predetermined angle.

The control switch 13 is made up of a moving contact 13*a* which when neutral does not touch any other contact, a first fixed contact 13*b* with which the moving contact 13*a* makes contact when the key cylinder 14 or the lock knob 15 of the side door 3 is unlock-operated, and a second fixed contact 13*c* with which the moving contact 13*a* makes contact when the key cylinder 14 or the lock knob 15 is lock-operated. The control switch 13 produces an "unlock operation" signal when the key cylinder 14 or the lock knob 15 is unlock-operated and produces a "lock operation" signal when either of them is lock-operated.

The auxiliary response switch 53 is a normally-off switch which is turned on when the auxiliary motor 45 has rotated forward through a predetermined angle (on completion of unlocking of the auxiliary latch 52 of FIG. 2), and is turned off when the auxiliary motor 45 rotates in reverse.

The second switch 71 is made up of a moving contact 71*a* which does not touch any other contact when the key cylinder 72 is neutral (in the neutral position N of FIG. 4), a first fixed contact 71*b* with which the moving contact 71*a* makes contact when the key cylinder 72 is unlock-operated (moved to the unlock position Ul of FIG. 4), and a second fixed contact 71*c* with which the moving contact 71*a* makes contact when the key cylinder 72 is lock-operated (moved to the lock position Lc of FIG. 4). The second switch 71 produces an "unlock operation" signal when the key cylinder 72 is unlock-operated and produces a "lock operation" signal when it is lock-operated.

The control unit 80 is made up of a control part 81 and a relay 82.

The control part 81 has a power supply terminal V connected to a d.c. power supply 83, input terminals $I_1$, $I_2$ connected to the first and second fixed contacts 13*b*, 13*c* of the control switch 13, input terminals $I_3$, $I_4$ connected to the first and second fixed contacts 12*b*, 12*c* of the response switch 12 and connected to the first and second fixed contacts 71*b*, 71*c* of the second switch 71, output terminals $O_1$, $O_2$ connected to the door lock motor 11, and output terminals $O_3$, $O_4$ connected to the auxiliary motor 45. The moving contacts 12*a*, 13*a* and 71*a* are connected to ground.

Normally-open contacts of the first switch 61, a coil 82*a* of the relay 82 and the auxiliary response switch 53 connected in series are connected in parallel with normally-open contacts 82*b* of the relay 82 and the main motor 31 connected in series.

Next, a control procedure for when the control part 81 is a microcomputer will be described on the basis of FIG. 8 and the flow chart shown in FIG. 9.

Step (hereinafter abbreviated to ST) 01: it is determined whether there has been a side door "unlock operation" signal from the control switch 13; if the determination is YES then processing proceeds to ST02 and if it is NO then processing proceeds to ST11.

ST02: The door lock motor 11 is rotated forward.

ST03: It is determined whether there has been an "unlocking completed" signal from the response switch 12; if the determination is YES then processing proceeds to ST04 and if it is NO then this step is repeated.

ST04: The door lock motor 11 is stopped.

ST05: The auxiliary motor 45 is rotated forward.

ST06: It is determined whether the auxiliary motor 45 has rotated forward through a predetermined angle. For example, the rotating time is counted and if a predetermined time has elapsed processing proceeds to ST07 and if the predetermined time has not elapsed the step is repeated.

ST07: The auxiliary motor 45 is stopped and control is ended. At this point the auxiliary response switch 53 turns on.

ST11: It is determined whether there has been a side door "lock operation" signal from the control switch 13; if the determination is YES then processing proceeds to ST12, and if the determination is NO then processing proceeds to ST21.

ST12: The door lock motor 11 is rotated in reverse.

ST13: It is determined whether there has been a side door "locking completed" signal from the response switch 12; if the determination is YES then processing proceeds to ST14, and if it is NO then this step is repeated.

ST14: The door lock motor 11 is stopped.

ST15: The auxiliary motor 45 is rotated in reverse.

ST16: It is determined whether the auxiliary motor 45 has rotated in reverse through a predetermined angle. For example, the rotating time is counted and if a predetermined time has elapsed processing proceeds to ST07 and if the predetermined time has not elapsed the step is repeated.

ST21: It is determined whether there has been a key cylinder "unlock operation" signal from the second switch 71; if the determination is YES then processing proceeds to ST05, and if it is NO then processing proceeds to ST22.

ST22: It is determined whether there has been a key cylinder "lock operation" signal from the second switch 71; if the determination is YES then processing proceeds to ST15, and if it is NO then processing returns to ST01.

The above-mentioned steps ST01 through ST04 constitute side door unlocking drive means; steps ST11 through ST14 constitute side door locking drive means; steps ST21 and ST05 through ST07 constitute auxiliary latch unlocking drive means; and steps ST22, ST15, ST16 and ST07 constitute auxiliary latch locking drive means.

After step ST07 is completed, referring to FIG. 8, if the first switch 61 is turned on, in the relay 82 the coil 82*a* is excited and switches the normally-open contacts 82*b* on. As a result, the main motor 31 rotates and unlocks the main latch 44 (see FIG. 2).

Next the operation of the back door lock device 20 will be described, first in outline on the basis of FIG. 10 and then in detail on the basis of FIG. 2.

Figure 10:
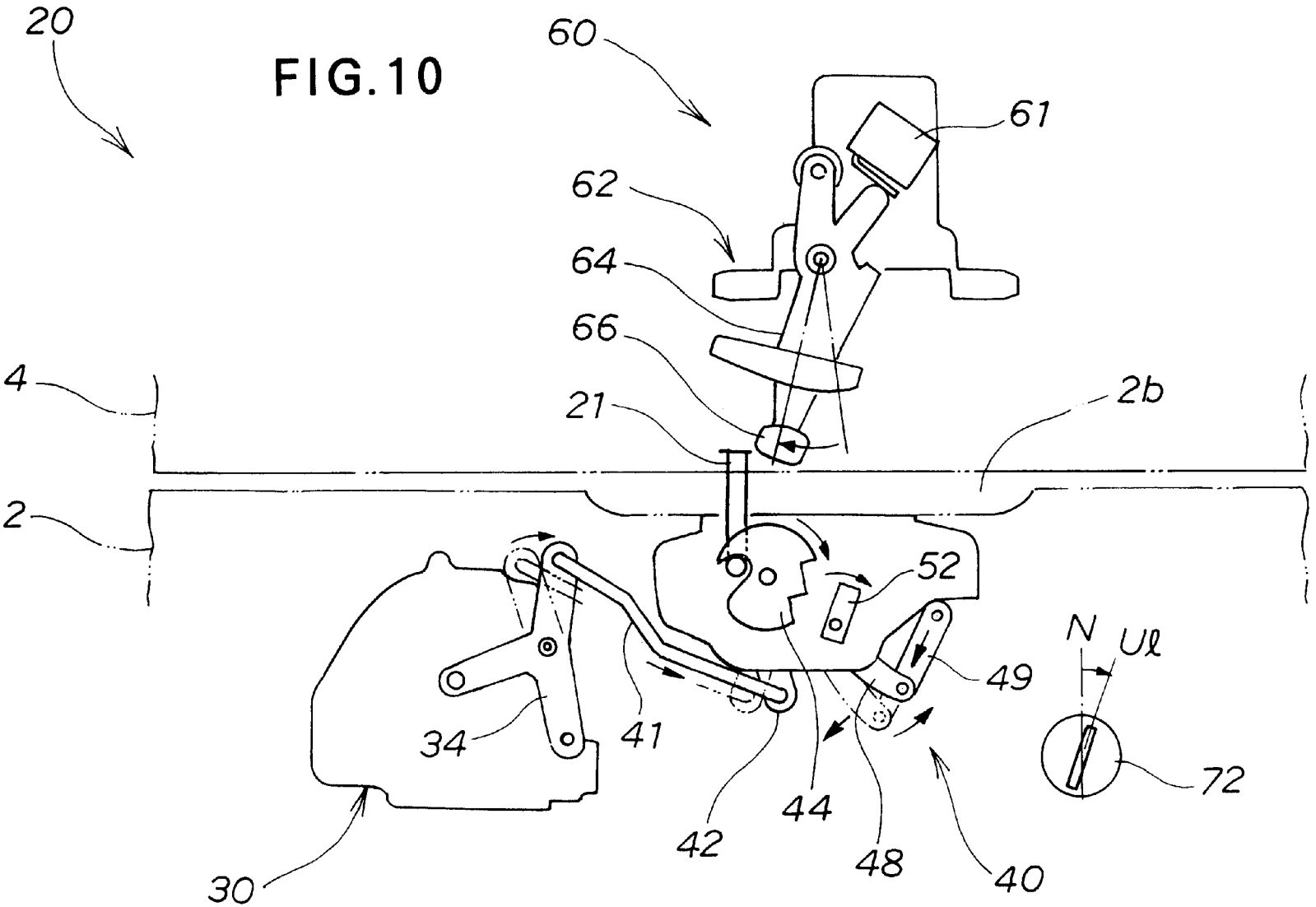
FIG. 10 is a view illustrating the operation of a back door lock device according to the present invention.

FIG. 10 is a view illustrating the operation of the back door lock device 20.

To unlock-operate the back door lock device 20, first, by switching the key cylinder 72 to the unlock position Ul, the auxiliary motor 45 (see FIG. 2) is rotated forward and thereby the first auxiliary lever 48 is rotated clockwise and the auxiliary link 49 is lowered. At this time the auxiliary latch 52 has not yet rotated and is still engaged with the main latch 44. When the manual switching mechanism 62 is then operated in the clockwise direction, the first switch 61 is turned on, the main motor 31 (see FIG. 2) rotates forward and rotates the second main lever 34 in the clockwise direction, and the first rod 41 moves to the right. This rightward movement of the first rod 41 causes the auxiliary latch 52 to rotate clockwise and disengage from the main latch 44. Consequently, the main latch 44 rotates clockwise and disengages from the striker 21, whereby the back door 4 is unlocked.

The operation of the back door lock device 20 will now be described in detail on the basis of FIG. 2.

To unlock the back door lock device 20, the following procedure is carried out.

(1) First, the key cylinder 72 is switched to the unlock position Ul and an "unlock operation" signal is supplied to the control unit 80 through the second switch 71.

(2) The control unit 80 rotates the auxiliary motor 45 forward and the auxiliary motor 45 drives the auxiliary worm gear mechanism 46.

(3) Because the wheel 46*b* rotates counterclockwise, the respective end of the first auxiliary lever 48 is guided by the cam groove 47 curving from the periphery toward the center of the wheel 46*b* and the first auxiliary lever 48 pivots clockwise about the support shaft 57. As a result of this pivoting of the first auxiliary lever 48, the auxiliary link 49 moves downward and causes the fourth main lever 51 to pivot clockwise about the support shaft 55. As a result of this pivoting of the fourth main lever 51, the main link 43 connected to the fourth main lever 51 by the pin 51*a* pivots clockwise about the connecting pin 42*a* through a play space 43*c* of the bent-out portion 43*b*.

(4) At this time, the auxiliary latch 52 is being urged counterclockwise by a compression spring 58 and is still engaged with the main latch 44.

(5) At this point, the control unit 80 stops the auxiliary motor 45. Also, the first auxiliary lever 48 turns the auxiliary response switch 53 on.

(6) After that, when with one hand the knob 66 of the manual switching mechanism 62 is moved to the left while the back door 4 (see FIG. 6) is lifted, the first switch 61 is turned on.

(7) When in addition to the auxiliary response switch 53 being on the first switch 61 comes on, the relay 82 shown in FIG. 8 operates and the normally-open contacts 82*b* thereof are turned on.

(8) As a result, the main motor 31 rotates forward and drives the gear mechanism 32.

(9) The sector gear 32*f* of the gear mechanism 32 pivots the second main lever 34 clockwise by way of the first main lever 33.

(10) As a result of the pivoting of the second main lever 34, the first rod 41 moves to the right and the third main lever 42 pivots counterclockwise about the support shaft 54. As a result of this pivoting of the third main lever 42, the main link 43 moves to the right as shown with an arrow in FIG. 2 through the length of the slot 43*a*. When this main link 43 moves to the right, the bent-out portion 43*b* formed on the main link 43 makes contact with the pin 52*a* projecting from the auxiliary latch 52 and consequently the auxiliary latch 52 is pivoted clockwise about the support shaft 55 as shown with an arrow and the auxiliary latch 52 disengages from the main latch 44.

(11) As a result, the main latch 44 is pivoted clockwise by the spring force of a compression spring 59 which urges the main latch 44 clockwise at all times and the main latch 44 disengages from the striker 21 and thereby unlocks the back door 4.

(12) The back door 4 thus disengaged from the main latch 44 can now be opened.

In this way, the back door lock device 20 can unlock the back door 4 by a two-stage motion.

The locking operation of the back door lock device 20 will now be described.

(1) First, the open back door 4 (see FIG. 6) is pushed down and closed. At this time, a lower jaw part 44*b* of the main latch 44 is pushed down by the lower end of the striker 21 and the main latch 44 rotates counterclockwise against the resistance of the compression spring 59 and an upper jaw part 44*a* of the main latch 44 engages with the striker 21 and thereby locks the back door 4.

(2) When the main latch 44 locks, it drives the gear mechanism 32 by way of the main link 43, the third main lever 42, the first rod 41, the second main lever 34 and the first main lever 33. However, because there is the slip mechanism 35 between the wheel 32*b* and the first small gear 32*c*, the wheel 32*b* does not try to rotate.

(3) Next, when the key cylinder 72 is switched to the lock position Lc, the second switch 71 supplies a "lock operation" signal to the control unit 80.

(4) The control unit 80 rotates the auxiliary motor 45 in reverse and the auxiliary motor 45 drives the auxiliary worm gear mechanism 46.

(5) Because the wheel 46*b* rotates clockwise, the first auxiliary lever 48 pivots counterclockwise. Also, the first auxiliary lever 48 pivots the fourth main lever 51 counterclockwise by way of the auxiliary link 49. This counterclockwise pivoting of the fourth main lever 51 moves the main link 43 to the left.

(6) As a result, the pin 52*a* of the auxiliary latch 52 and the bent-out portion 43*b* of the main link 43 cease to be contactable, and consequently even if the third main lever 42 pivots counterclockwise, the auxiliary latch 52 pivots counterclockwise under the spring force of the compression spring 58 and engages with and locks the main latch 44.

(7) At this point, the control unit 80 stops the auxiliary motor 45. Also, the first auxiliary lever 48 turns the auxiliary response switch 53 off during the reverse rotation of the auxiliary motor 45.

(8) After that, if the manual switching mechanism 62 is moved to the left, the first switch 61 will come on.

(9) However, the auxiliary response switch 53 is off and the relay 82 shown in FIG. 8 does not operate.

(10) As a result, the main motor 31 does not rotate and the main latch 44 remains locked.

The main link 43 and the fourth main lever 51 are connected by the slot 43*a* and the pin 51*a*, and during unlocking or locking by rotation of the main motor 31 or the auxiliary motor 45 neither of them has any influence on the other.

Figure 9:
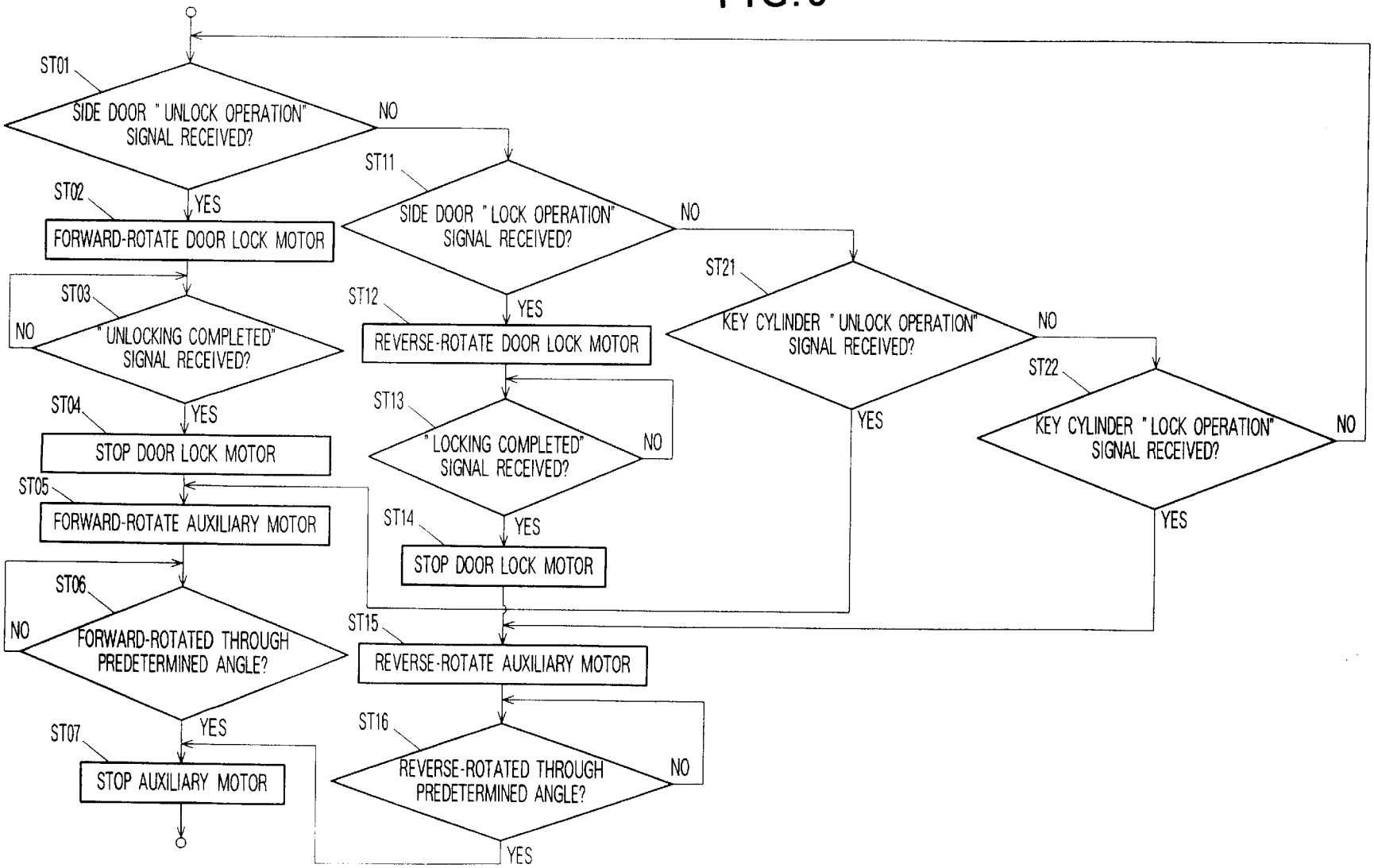
FIG. 9 is a control flow chart of a control part shown in FIG. 8.

Also, locking or unlocking by rotation of the main motor 31 or the auxiliary motor 45 is the same when instead of the key cylinder 72 being operated the key cylinder 14 or the lock knob of the side door 3 is operated, and is carried out on the basis of the steps of the control flow chart of the control part 81 shown in FIG. 9.

To forcibly unlock the back door lock device 20 without driving the main motor 31 and the auxiliary motor 45, on the other hand, the following procedure is carried out.

(1) First, the key cylinder 72 is switched to the forcible unlock position Ku to the right of the unlock position Ul shown in FIG. 4.

(2) When this is done, the arm 74 rotates the second main lever 34 clockwise by way of the second rod 73.

(3) By moving the first rod 41 to the right, the second main lever 34 pivots the auxiliary latch 52 clockwise by way of the main link 43. This clockwise pivoting of the auxiliary latch 52 is effected by the third main lever 42 pivoting counterclockwise about the support shaft 54 and moving the main link 43 to the right and the bent-out portion 43*b* of the main link 43 making contact with the pin 52*a* of the auxiliary latch 52.

(4) Then, the main latch 44 disengages from the striker 21.

(5) The unlocked back door 4 can then be lifted open.

In the preferred embodiment of the invention described above, the construction connecting the main motor (first motor) 31 to the main latch (first latch) 44 may be any suitable construction, and for example the main motor 31 and the main latch 44 may be connected directly. The same also applies to the construction connecting the auxiliary motor (second motor) 45 to the auxiliary latch (second latch) 52.

Also, the manual switching mechanism 62 does not have to be a lever mechanism and for example may alternatively be of a handle type.

Also, the car 1 is not limited to a hatchback type vehicle and for example may be a sedan type vehicle. And the a door to be locked by the two-stage operation type door lock system may be of any type, including tailgate, trunk and side doors.

Obviously, various minor changes and modifications of the present invention are possible in the light of the above teaching. It is therefore to be understood that within the scope of the appended claims the present invention may be practiced otherwise than as specifically described.

What is claimed is:

1. A door lock system for a vehicle, said vehicle having a body and a door, functionally attached to said body, comprising:

a substantially U-shaped striker;

a first latch for locking the striker;

a first motor for switching the first latch between a locking state and a non-locking state;

a first switch for starting the first motor;

a manual switching mechanism for switching the first switch on and off;

a second latch for locking the first latch in its locking state;

a second motor for operating the second latch;

a second switch for starting the second motor; and a key cylinder for switching the second switch, wherein the striker, the first switch and the manual switching mechanism are adapted for mounting to the door and the first latch, the first motor, the second latch, the second motor, the second switch and the key cylinder are adapted for mounting to the vehicle body.

* * * * *